US005566637A

United States Patent [19]

Benza

[11] Patent Number: 5,566,637

[45] Date of Patent: Oct. 22, 1996

[54] BOAT CABIN TOP DECK MOLD ASSEMBLY WITH BUILT-IN ICE CHEST

[76] Inventor: Kenneth C. Benza, 4000 Iva La., Fairfax, Va. 22032

[21] Appl. No.: 559,995

[22] Filed: Nov. 17, 1995

[51] Int. Cl.[6] ..... B63B 17/00

[52] U.S. Cl. ..... 114/343; 114/363

[58] Field of Search ..... 62/26.1, 457.1, 62/371, 240, 245, 244, 464; 114/183 R, 363, 343, 364, 270, 188; 312/400, 401, 402, 405; 296/38; 297/271.1

[56] References Cited

U.S. PATENT DOCUMENTS 1,286,575 12/1918 Fratt .
2,473,874 6/1949 Ganong ..... 114/343
3,475,772 11/1969 Lokken ..... 114/183 R
4,398,488 8/1983 Mathieu ..... 114/343
4,528,925 7/1985 Pyburn ..... 114/343
4,989,535 2/1991 Lacasse et al. ..... 114/343

*Primary Examiner*—Edwin L. Swinehart
*Attorney, Agent, or Firm*—Lorusso & Loud

[57] ABSTRACT

An ice chest and boat hull mounting include a drawer with a drain hole for draining water by gravity. The drawer is slidably mounted in a recess in a top deck assembly within the boat hull and the recess is provided with a stationary tray for receiving water drained from the drawer in all positions of the drawer allowed by the sliding mounting. Water is drained from the stationary tray through a tray drain hole, a conduit and, finally, through a drain hole provided in the boat hull.

4 Claims, 3 Drawing Sheets

BOAT CABIN TOP DECK MOLD ASSEMBLY WITH BUILT-IN ICE CHEST

BACKGROUND OF THE INVENTION

1. Field of the Invention

The present invention relates to the combination of a boat hull, specifically the cabin top deck mold assembly, and a built-in ice chest.

2. Prior Art

Larger boats such as cabin cruisers are often provided with refrigerators mounted in a portion of the cabin top deck mold assembly, e.g. in the port companion seat of a bridge elevated above the deck of a boat. However, such refrigerators are expensive and difficult to maintain.

Boaters typically carry aboard portable ice chests for day excursions. However, portable ice chests tend to clutter the deck and present a safety hazard.

SUMMARY OF THE INVENTION

Accordingly, it is the object of the invention to provide an economical ice chest for use aboard a boat which is maintenance free and which presents no safety hazard.

In furtherance of the foregoing objective, the present invention provides a combination of a boat hull including side boards, a transom and a top deck assembly, with a hull drain hole provided in either a side board or the transom. An ice chest is slidably mounted in a recess in the top deck assembly and includes a drawer having a longitudinal dimension defining a longitudinal axis. A drawer drain hole serves to drain water from the drawer by gravity. The drawer is mounted for sliding movement, relative to the top deck assembly, along the longitudinal axis. A stationary tray is mounted in the bottom of the recess and extends over a length at least substantially coextensive with the longitudinal dimension of the drawer for receipt of water draining from the drawer, in all positions of the drawer relative to the recess. The tray is provided with a tray drain hole and an upper surface sloped toward that drain hole whereby water draining from the drawer is collected for discharge through the drain hole. A conduit connects the tray drain hole with a hull drain hole for discharge of the water out of the boat through the hull drain hole.

DESCRIPTION OF THE PREFERRED EMBODIMENTS

Figure 1:
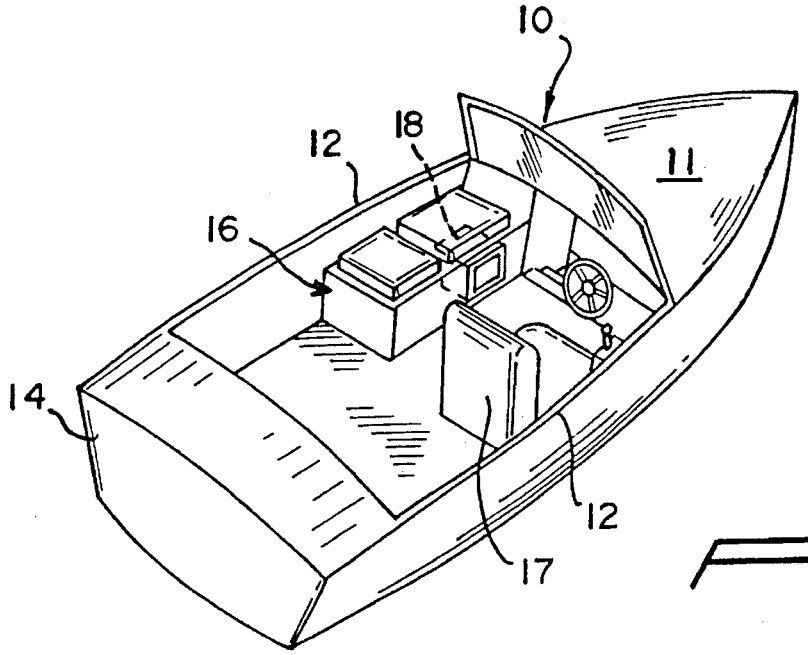
FIG. 1 is a plan view of a cabin cruiser with a built-in ice chest, in accordance with the present invention.
Figure 2:
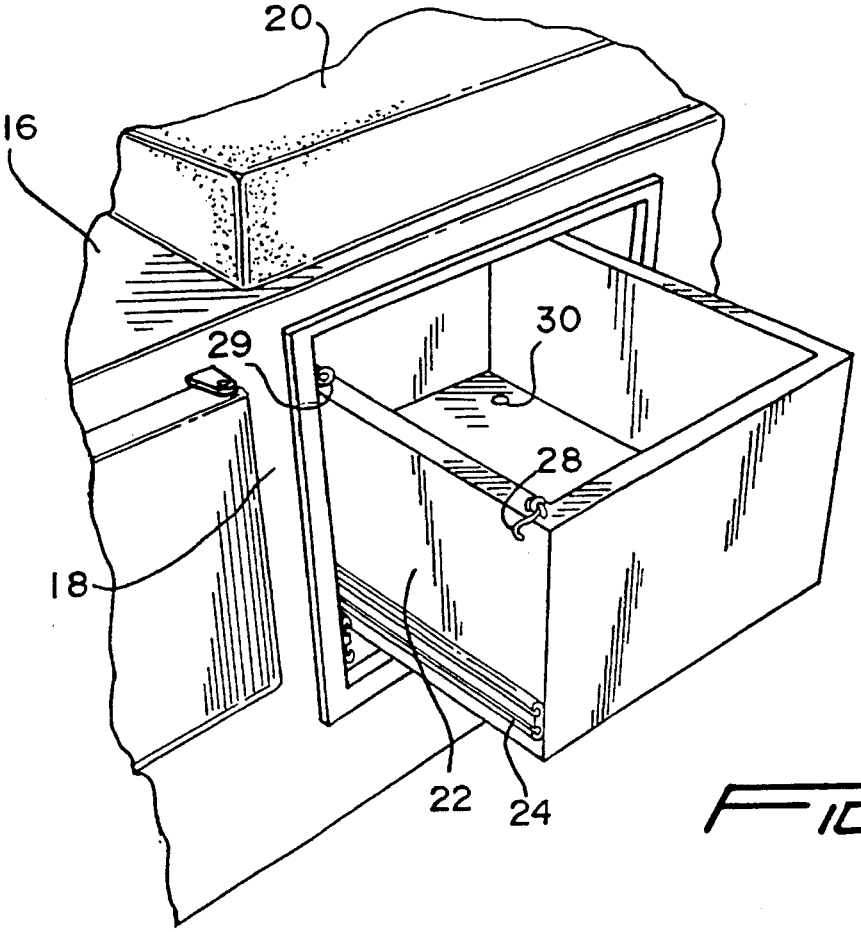
FIG. 2 is a perspective view of the ice chest and a recessed housing in the top deck assembly of the boat which receives the ice chest.
Figure 3:
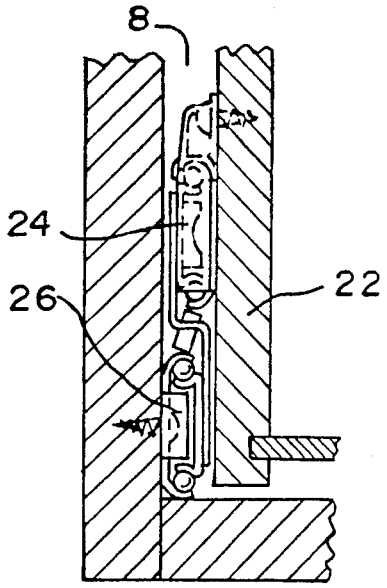
FIG. 3 is a detailed view of a drawer slide by which the drawer is mounted within the recess of the top deck assembly.

FIG. 1 illustrates a cabin cruiser having a hull 10 defined by side boards 12 and transom 14. A top deck mold assembly 16 is shown as including a captain's seat 17, a port companion seat 18 and a cabin 11. The captain's seat 17 and the port companion seat 18 are formed on an elevated structure or bridge which provides a clear view over the boat cabin 11. The port companion seat 18 is covered by a seat cushion 20 and is provided with a recess 19 for receipt of a slidably mounted ice chest drawer 22 in accordance with the present invention. FIG. 2 shows the ice chest drawer 22 slidably mounted in recess 18 on a pair of drawer slides 24 (only one of which is shown). A hook 28 on ice chest drawer 22 may be engaged in eyelet fix to the port companion seat 19 to secure drawer 22 in a closed position.

Figure 4:
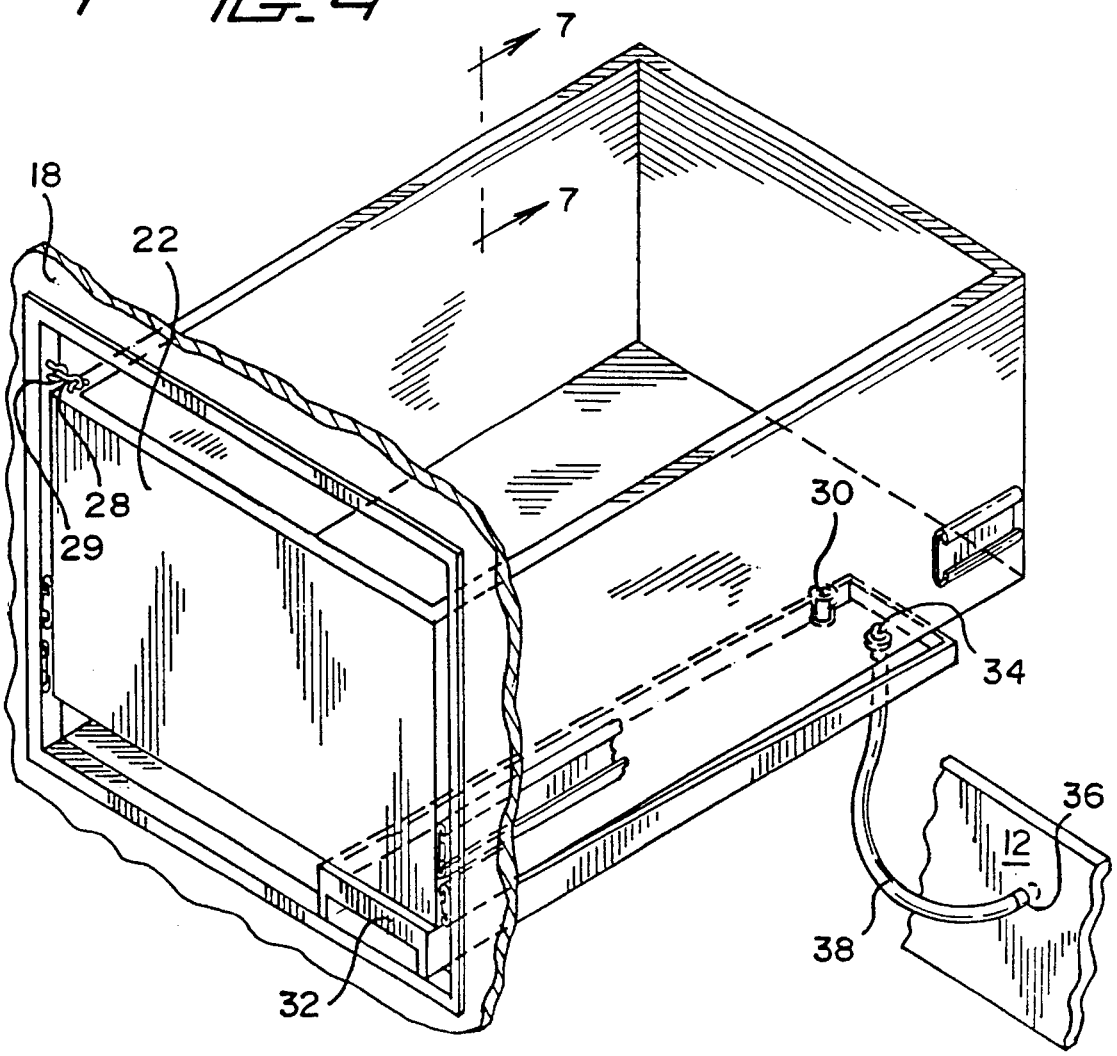
FIG. 4 is a schematic perspective view of the ice chest, drain line and boat hull discharge hole.

FIG. 4 illustrates the overall drain system of the present invention. The drawer 22 is mounted in the recess 19 under the port companion seat 18. A cooler drain 30 is located in the rear bottom portion of the drawer 22 and empties water from the drawer 22 into a tray 32. In turn, water is collected in tray 32 and funnelled to a drain hole 34 which discharges the collected water through a conduit 38 and out through the boat hull 10, via a hull drain hole 36 in side board 12.

Figure 6:
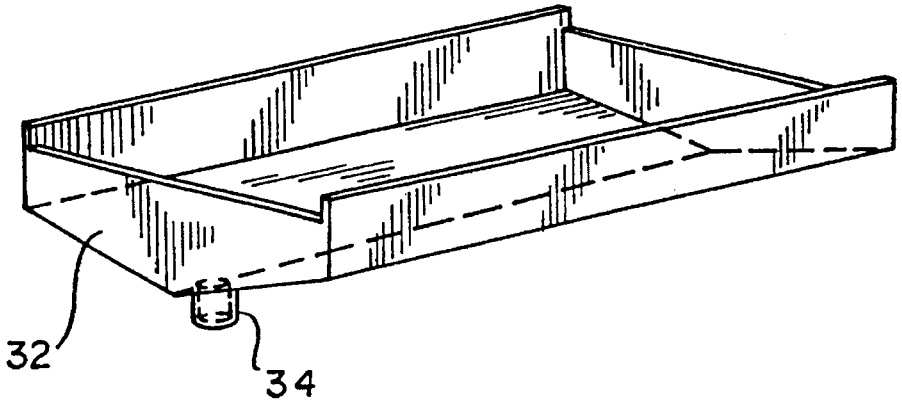
FIG. 6 is a perspective view of an alternative embodiment of the tray which is mounted within the recess below the sliding drawer.

FIG. 6 shows an alternative embodiment of the tray 40. As can be seen in FIG. 6, the bottom of tray 40 is a sloped surface which defines a trough feeding the collected water to the tray drain 42.

Figure 7:
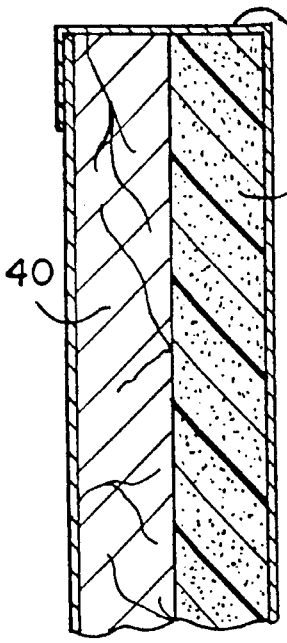
FIG. 7 is an exploded detail view in cross-section taken along line A—A in FIG. 4.
Figure 5:
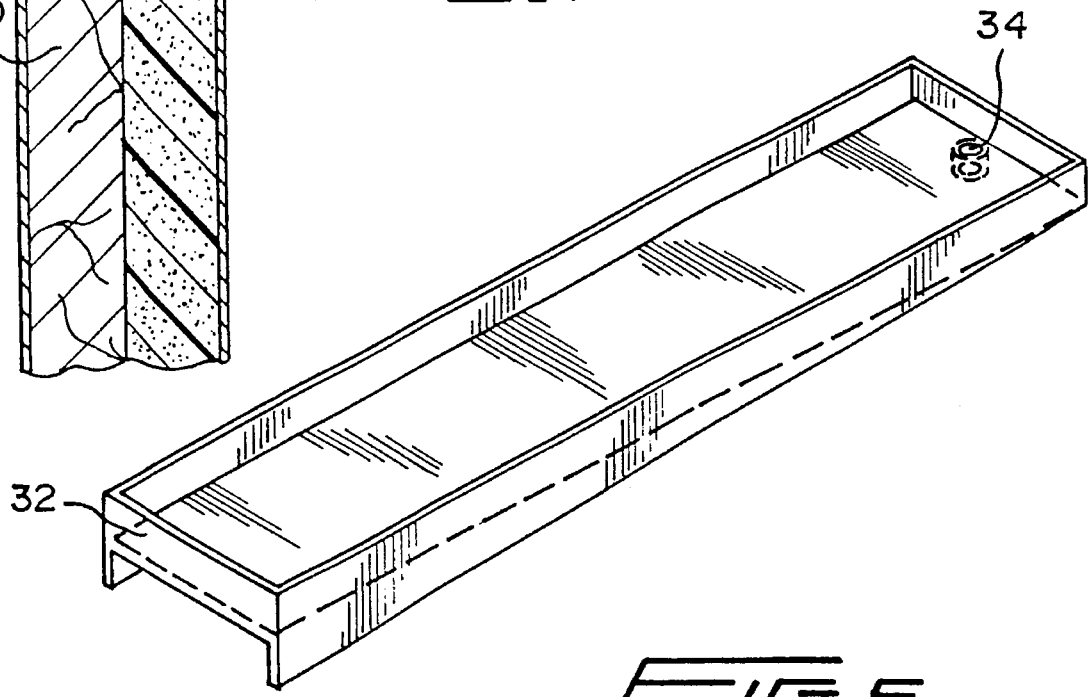
FIG. 5 is a perspective view of the tray mounted within the recess below the sliding drawer.

FIG. 7 shows a preferred construction for the drawer 22 consisting of an inner layer of rigid resinous foam insulation 42, e.g. styrofoam, an outer wood box 40 and covering steel sheet 44.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A combination of a boat hull, the boat hull including side boards, a transom and a top deck assembly with a hull drain hole provided in one of said side boards and transom, and an ice chest slidably mounted in a recess in the top deck assembly, said ice chest comprising:

a drawer having a longitudinal dimension extending along a longitudinal axis and a drawer drain hole for draining water from said drawer by gravity;

mounting means for sliding said drawer, relative to the top deck assembly, along said longitudinal axis;

a stationary tray, mounted in the bottom of the recess and extending over at least substantially said longitudinal dimension, for receiving water drained from said drawer in all positions of the drawer allowed by said sliding, said tray having a tray drain hole and an upper surface sloped toward said tray drain hole; and a conduit for discharging water from said tray drain hole out of the boat hull through said hull drain hole.

2. A combination in accordance with claim 1 wherein said upper surface of said tray defines a trough.

3. A combination in accordance with claim 1 wherein said mounting means consists of a pair of drawer roller slides.

4. A combination in accordance with claim 1 wherein the top deck assembly includes a seat and said recess is located below said seat.

* * * * *